United States Patent [19]

Beauducel

[11] Patent Number: 4,996,675

[45] Date of Patent: Feb. 26, 1991

[54] SIGNAL SENSOR INSENSITIVE TO STATIC PRESSURE VARIATIONS

[75] Inventor: Claude Beauducel, Henonville, France

[73] Assignee: Institut Francais du Petrole, Rueil-Malmaison Cedex, France

[21] Appl. No.: 454,973

[22] Filed: Dec. 22, 1989

[30] Foreign Application Priority Data

Dec. 23, 1988 [FR] France ..... 88 17205

[51] Int. Cl.[5] ..... H04R 17/00

[52] U.S. Cl. ..... 367/162; 367/166; 367/167; 367/171; 367/172; 310/337

[58] Field of Search ..... 310/337; 367/162, 166, 367/167, 171, 172, 160, 152

[56] References Cited

U.S. PATENT DOCUMENTS

| | | | |
|---|---|---|---|
| 3,372,370 | 3/1968 | Cyr | 367/172 |
| 3,375,489 | 3/1968 | Kompanek | 367/172 |
| 3,380,019 | 4/1968 | Sims | 367/157 |
| 3,794,866 | 2/1974 | McElroy et al. | 367/152 |
| 3,900,543 | 8/1975 | Davis | 367/154 |
| 4,166,229 | 8/1979 | DeReggi et al. | 310/337 |
| 4,439,497 | 3/1984 | DiFoggio | 367/157 |

FOREIGN PATENT DOCUMENTS 916593 8/1954 Fed. Rep. of Germany .

*Primary Examiner*—Charles T. Jordan
*Assistant Examiner*—J. Woodrow Eldred
*Attorney, Agent, or Firm*—Antonelli, Terry, Stout & Kraus

[57] ABSTRACT

A signal sensor automatically compensates for the variations of the static pressure of the medium in which it is placed. The signal sensor comprises one or two assemblies each formed of a piezoelectric sensitive element applied against one face of a flexible plate. The other face of the plate is shielded from the variations of the dynamic pressure to be measured by a material absorbing the vibrations but fairly flexible so as to transmit any variation of the ambient static pressure. This material which may be a porous foam or a fibrous substance impregnated with liquid, fills a tubular apertured sleeve.

13 Claims, 1 Drawing Sheet

SIGNAL SENSOR INSENSITIVE TO STATIC PRESSURE VARIATIONS

BACKGROUND OF THE INVENTION

1. Field of the Invention

The present invention relates to a signal sensor insensitive to variations of the static pressure reigning in the medium where it is disposed.

Such a signal sensor may be used in any medium in which it is desired to make acoustic signal measurements and particularly in water. It is suitable, in oceanography for example, for carrying out undersea detection operations or else for forming multi-sensor reception devices suitable for marine seismic prospection operations.

2. Description of the Prior Art

From the French Pat. No. 2 122 675, a hydrophone is known comprising two circular plates. One at least of the plates comprises a central flexible portion against which is fixed a sensitive element formed of a piezoelectric ceramic disk associated with an electrode on each of its two flat opposite faces. The peripheral portion of the two plates is reinforced and rigid. The two plates are applied one against the other and define an inner air-filled cavity. The variations of the seismic signals to be measured deform each flexible central portion. Each sensitive element operates under flexion, which gives it a high sensitivity. The static pressure which increases with the depth of immersion, for example, causes each flexible plate to bend inwardly of the case. The device is designed so that possible deformation of the flexible plates under the effect of the static pressure remains reversible. For this, the spacing between the two plates is chosen for example so that they abut one against the other before their deformation becomes irreversible.

Such a hydrophone is suitable for a given range of depths.

By making the two opposite plates thicker, the range of depths in which the hydrophone operates may be widened but to the detriment of its sensitivity. It should also be noted that the electric capacity of each sensitive element operating under flexion varies with the amount of flexion of the deformation. The response of the hydrophone changes then with the depth.

From the French Pat. No. 1 556 971, a hydrophone is also known comprising a sensitive element fixed to a thin flexible plate, which is secured to a rigid body. The latter has two inner air-filled cavities communicating through a capillary canal. A first cavity is separated from the external medium by a flexible membrane. The external surface of the flexible plate is exposed to the pressure to be measured. The pressure prevailing in the second cavity is applied to its internal face. The variations of the external pressure are transmitted into the first cavity by deformation of the flexible membrane. but the capillary canal acting as a low pass filter prevents the transmission of the dynamic variations of the pressure to be measured into the second cavity, from the inner side of the thin plate. The dynamic pressure variations may then be measured.

With such an arrangement, the range of depths in which the hydrophone may operate is appreciably increased. The limits are fixed essentially by the ability of the membrane to compensate, by its deformation, the variations of the external static pressure. It may also be noted that the dynamic variation filtering effect provided by the capillary, depends on its length. If it is desired to widen the passband of such a hydrophone as much as possible towards the low frequencies, a very long capillary must be used. In practice, such a solution is difficult to reconcile with the construction of very small hydrophones such as is used in large numbers for the construction of seismic streamers for example.

SUMMARY OF THE INVENTION

The sensor of the invention avoids the above drawbacks.

It comprises at least one flexible plate, a sensitive element fixed to this plate and filtering means for shielding one of the faces of the plate from the dynamic variations of the pressure of the medium. In this sensor, the filtering means comprise a volume of substantially incompressible absorbent material adapted for transmitting to this face the variations of the static pressure of the medium.

The volume of substantially incompressible absorbent material is contained, for example, in a case open to the medium.

The volume of substantially incompressible absorbent material is formed, for example, from fibers made from a rigid material from a so-called syntactic substance, from balls made from a solid material (glass for example) coated with a binder or bathing in a liquid.

In one embodiment, the sensor of the invention comprises at least one pair of flexible plates each having a sensitive element and a volume of a substantially incompressible absorbent material for shielding one face of each of the plates from the dynamic variations of the pressure in the medium.

The flexible plates are, for example, walls of a common case containing the volume of damping material and having apertures, with this case possibly comprising a grating covered portion and being filled for example with glass balls.

When the damping material is sufficiently coherent to be cut into blocks, the sensor of the invention may be constructed by applying at least one flexible plate with its sensitive element against a face of said block.

The volume of substantially incompressible absorbent material, whether it is solid or impregnated with liquid, being adapted to transmit any change of the static pressure of the medium, the two opposite faces of each flexible plate are therefore subjected to equal forces. The harmful effects and/or the limitations, caused in prior art sensors by the increase of the static pressure of the medium, are here totally overcome.

Since the absorbent material used is substantially incompressible, the sensor of the invention may withstand possible compression. This makes the use of piezoelectric ceramics possible, which are relatively fragile but have a high electro-acoustic efficiency, bonded to very thin and very flexible plates.

Whatever the embodiment chosen for forming the sensor of the invention, the structure is made simpler because the absorbent material is at equal pressure with the external medium and even, in some cases, is impregnated with this medium itself. The difficulties which could be met with for sealingly isolating the internal medium of the case of the sensor are here eliminated.

The construction of a case with apertures and, for example, covered with a grating portion and filled with absorbent material is very easy to achieve. So a very sensitive small-sized sensor may be obtained at lower cost.

BRIEF DESCRIPTION OF THE DRAWINGS

Other features and advantages of the sensor of the invention will be clear from reading the description of embodiments given by way of examples with reference to the accompanying drawings in which.

DESCRIPTION OF THE PREFERRED EMBODIMENTS

Figure 1:
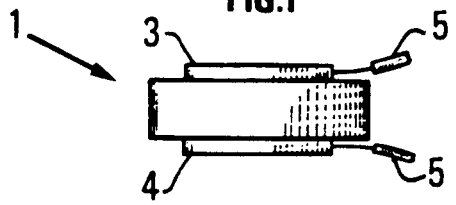
FIG. 1 shows the construction of a sensitive element.

Each pressure sensor comprises (FIG. 1) one or more sensitive elements 1, each formed, for example, of a disk 2 made from a piezoelectric material to the opposite faces of which are bonded two conducting films 3, 4 forming the collecting electrodes. Electric conductors 5 connect the electrodes to a matching amplifier (not shown) as is well known.

Figure 2:
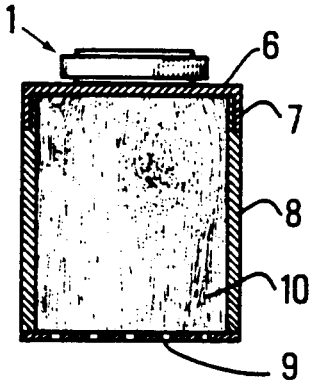
FIG. 2 shows a first embodiment of the sensor with a single flexible plate.

In the embodiment shown in FIG. 2, the sensor comprises, for example, a sensitive element 1 applied against a thin and flexible circular plate 6 having an annular flange 7. This flanged plate 6, 7 is crimped to one end of a rigid tubular sleeve 8. The opposite end of the sleeve is closed by an apertured plate 9, grating such as, for example, grating. The apertures cause the inside of sleeve 8 to communicate with the external medium. The inside of the sleeve 8 is filled with a damping material 10 chosen for its ability to filter the dynamic variations of the external pressure down to very low frequencies.

Different materials may be suitable. For example, a fibrous material can be chosen such as a glass fiber or textile wick. In operation, this fibrous material is impregnated with the fluid in which the pressure sensor is plunged. The static pressure of the fluid is therefore exerted on both sides of the flanged plate 6 supporting the sensitive element 1. Because of the filtering provided by the damping material 10, the dynamic variations of the fluid pressure are exerted on only one side of the flexible plate. The sensitive element 1 may then pick up the vibrations of this plate and transform them into an electric signal.

Figure 3:
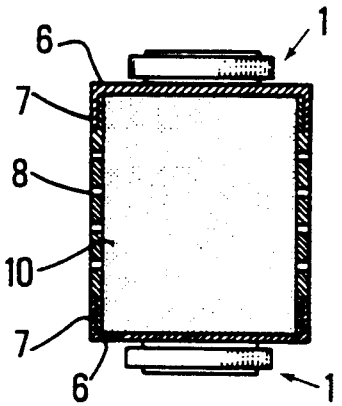
FIG. 3 shows a second embodiment of the sensor with two flexible plates.

In the embodiment of FIG. 3, the sensor comprises two sensitive elements 1 associated respectively with two identical flanged plates 6, 7 capping the opposite ends of a sleeve 8 whose side wall is pierced with numerous orifices 11. The inside of sleeve 8 is filled with a similar damping material, a fibrous substance or else a porous substance capable of being impregnated with the fluid penetrating into the sleeve through apertures 11. Similarly, this damping material operates to shield the internal faces of the two plates 6, 7 from the static pressure of the medium. The two sensitive elements 1 are interconnected electrically (by conductors not shown) as is well known, so as to provide electric compensation of the accelerations.

As damping material a composite substance of so-called syntactic type may be further used.

Figure 4:
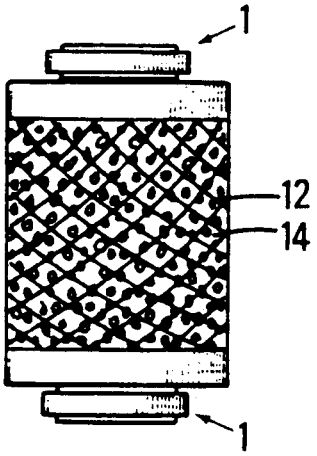
FIG. 4 shows a variant of the preceding embodiment.

In the embodiment shown in FIG. 4, the two flexible flanged plates 6, 7 cap the ends of a sleeve formed of a grating tube 12. The inside is filled with a fibrous or porous damping material as before or else glass particles or balls 13 of a few millimeters in diameter. These balls may be embedded in a binder 14 such as an epoxy resin.

The acoustic impedance of glass is very different from that of the bonding resin. Because of the high density of balls which it contains and so of glass/epoxy interfaces, the composite material absorbs the variable acoustic waves on the same side as the inner face of the flanged plates 6, 7. The external static pressure variations are however transmitted to the internal faces of these same plates 6, 7. With this embodiment also, the sensor is able to operate whatever the static pressure of the external medium. The balls or grains may be formed generally from any solid material whose acoustic impedance is different from that of the interstitial material.

In a variant, the interstitial substance between the balls may be replaced by the fluid in which the sensor is placed.

Figure 5:
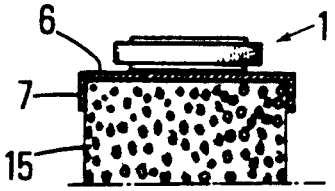
FIG. 5 shows a third embodiment of the sensor of the invention.
Figure 6:
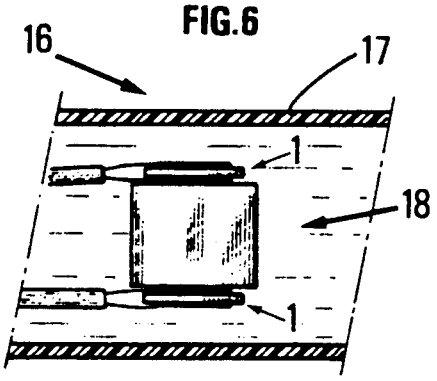
FIG. 6 shows one use of the sensor inside a seismic streamer.

In the embodiment of FIG. 5, the damping material has sufficient cohesion to be cut into a block 15. Each support flanged plate 6, 7 is applied directly against a face of block 15 so that its inner face is shielded from the dynamic pressure variations which are absorbed by the material.

Sensors, in one of the embodiments of FIGS. 2 to 5, may be included in a seismic streamer 16. The latter generally comprises a flexible sheath 17 of great length filled with oil or kerosine, for example, along the whole length of which are spaced apart a large number of pressure sensors 18. Because of the apertures formed in each sleeve 8, the damping material, when it is fibrous or porous, is impregnated with the liquid filling streamer 16. The external pressure variations, whether static or dynamic, are transmitted to the internal liquid through sheath 17. But here again, only the dynamic variations of the pressure are measured by each sensitive element.

In the different embodiments described, the fluid in which the sensor is placed may be used as interstitial fluid (case of glass balls) or as impregnation fluid (case of porous or fibrous materials). The fluid may be water if the sensor is used, as it is, as a hydrophone. It should however be noted that the damping effect on the acoustic signals is better when the liquid is viscous. This is the case of the liquid generally filling seismic streamers.

Without departing from the scope of the invention, the case of the sensor may be isolated from the external medium. The fluid thereinside is then held at an equal static pressure with the external medium by balancing means. The fluid may in this case be chosen as a function of its physical properties so as to form an optimum acoustic absorbent with the damping medium.

Still within the scope of the invention, the apertured cases shown in FIGS. 2 to 4 for example may be replaced by cases made from a sintered material which has the property of being transparent to static pressure variations. A suitable material may be obtained for example by compressing small balls together under high pressure. Its grain size depends on the size of the balls. In some cases, and in certain frequency bands at least, a case made from a sintered material also attenuates the dynamic pressure variations. It may be used alone or in combination with an acoustic absorbent such as those defined above, for absorbing the dynamic variations which might be transmitted to the inside.

What is claimed is:

1. Signal sensor, wherein said insensitive to variations of static pressure prevailing in a medium in which the signal sensor is placed, the signal sensor comprising a rigid case open to said medium, at least one plate having a central flexible portion, a sensitive element in the form of a disk fixed against a first face of said plate, and filtering means for shielding the opposite face of each plate from the dynamic variations of the pressure of the medium, wherein said filtering means comprise a volume of substantially incompressible absorbent material contained in the rigid case and adapted for transmitting the variations of the static pressure of the medium to said opposite face.

2. Signal sensor as claimed in claim 1, wherein said substantially incompressible absorbent material is made from rigid material fibers.

3. Signal sensor as claimed in claim 1, wherein said substantially incompressible absorbent material volume is made from a porous substance.

4. Signal sensor as claimed in claim 1, wherein said substantially incompressible absorbent material volume is made from a syntactic substance.

5. Signal sensor as claimed in claim 4, wherein said substantially incompressible absorbent material volume is made from particles of a solid substance associated with an interstitial material.

6. Signal sensor insensitive to variations of static pressure prevailing in a medium in which the signal sensor is placed, comprising at least one pair of flexible plates, a sensitive element in the form of a disk fixed against a first face of each of said plates, and filtering means for shielding the opposite face of each of the plates, wherein said filtering means comprise a volume of substantially incompressible absorbent material adapted for transmitting the variations of the static pressure of the medium to said opposite face and for shielding the opposite face of each of the plates from the dynamic variations of the pressure in the medium.

7. Signal sensor as claimed in claim 6, wherein the two flexible plates are walls of a common case containing said volume of substantially incompressible absorbent material and having apertures.

8. Signal sensor as claimed in claim 7, wherein said common case comprises at least one grating portion.

9. Signal sensor as claimed in claim 6, wherein said case is filled with solid material particles submerged in a liquid.

10. Signal sensor as claimed in claim 1 or 6, wherein said substantially incompressible absorbent material volume is a block at equal pressure with the static pressure of the medium, each plate being disposed against a face of said block.

11. The pressure sensor as claimed in claim 10, wherein said block is formed by embedding glass particles in a coating material.

12. Signal sensor as claimed in claim 1, wherein said filtering means comprise a case made from a sintered material.

13. Signal sensor as claimed in claim 1, wherein said rigid case is disposed inside a seismic streamer.

* * * * *